US011529287B2

(12) United States Patent
Lodge et al.

(10) Patent No.: US 11,529,287 B2
(45) Date of Patent: Dec. 20, 2022

(54) SEPTA

(71) Applicant: QIS, Inc., Rosenhayn, NJ (US)

(72) Inventors: Daniel B. Lodge, Rosenhayn, NJ (US); Alexander Mutin, Reisterstown, MD (US)

(73) Assignee: QIS, Inc., Rosenhayn, NJ (US)

( * ) Notice: Subject to any disclaimer, the term of this patent is extended or adjusted under 35 U.S.C. 154(b) by 18 days.

(21) Appl. No.: 17/146,645

(22) Filed: Jan. 12, 2021

(65) Prior Publication Data

US 2022/0218566 A1 Jul. 14, 2022

(51) Int. Cl.
*A61J 1/14* (2006.01)
*B65D 51/00* (2006.01)

(52) U.S. Cl.
CPC ..... *A61J 1/1406* (2013.01); *A61J 1/1418* (2015.05); *B65D 51/002* (2013.01)

(58) Field of Classification Search
CPC ..... A61J 1/1406; A61J 1/1418; B65D 51/002
USPC ..... 220/203.17; 604/411, 415
See application file for complete search history.

(56) References Cited

U.S. PATENT DOCUMENTS

| | | | | |
|---|---|---|---|---|
| 2,436,291 | A * | 2/1948 | Daniel | B65D 51/24 401/122 |
| 5,183,267 | A * | 2/1993 | Ackerman | F16J 15/06 277/630 |
| 6,752,965 | B2 * | 6/2004 | Levy | B01L 3/50825 215/349 |
| 8,397,386 | B2 * | 3/2013 | Weide | F16K 3/0227 264/261 |
| 8,926,582 | B2 * | 1/2015 | Wahl | B01L 3/50825 141/2 |
| 9,999,888 | B2 * | 6/2018 | Ziegler | B01L 3/5082 |
| 10,058,481 | B1 * | 8/2018 | Russo | B65D 51/00 |
| 2011/0130740 | A1 * | 6/2011 | Levy | A61J 7/0053 604/403 |

* cited by examiner

*Primary Examiner* — Timothy L Maust
(74) *Attorney, Agent, or Firm* — Norman E. Lehrer

(57) ABSTRACT

A septum includes a disc made of an elastomeric material that is capable of being pierced by a needle and resealing itself when the needle is withdrawn. Embedded in the middle of the disc, from top to bottom, is a ring made of a material that is more rigid than the elastomeric material of the disc. The ring has a center circular opening that is filled by the elastomeric material of the disc. The outer circumference of the ring is greater than the circumference of the disc and extends outwardly beyond the circumference of the disc. The outer part of the ring interacts with the inner screw threads of a cap and supports the septum in the cap. A plurality of additional openings equally spaced about the ring adjacent its outer circumference are also filled with the elastic material of the disc to provide additional support for the septum.

10 Claims, 2 Drawing Sheets

SEPTA

FIELD OF THE INVENTION

The present invention is directed toward septa and, more particularly, toward septa made from silicone as well as other non-silicone materials.

BACKGROUND OF THE INVENTION

Septa are barriers used to prevent contamination between a vessel's contents and the vessel's exterior environment. For example, to prevent contamination of an oxygen- and/or moisture-sensitive material contained in a flask or a bottle, a septum can be used to seal the mouth of the flask or bottle or other vessel. The septum can also be used, for example, to seal a vessel containing a hazardous material thereby preventing accidental spillage of the hazardous material.

The septa of the class associated with the present invention include an elastomeric material that can be punctured by a needle for transferring material into or out of the vessel. When a septum is punctured, for example, by a needle, compressed elastomeric material can create a seal around the needle as the needle is used to transfer material into or out of a vessel. When the needle is withdrawn from the septum, the compressed material forces the puncture closed and reseals the vessel. As a result, material can be transferred into and out of the vessel with reduced or no substantial contamination.

The most commonly used elastomeric material for producing septa is silicone. Silicone is flexible and compressible, which means it can create a good seal between the cap and the vial. The same property also allows silicone to somewhat reseal the puncture hole from a sampling needle. The negative feature of silicone is that it is not as inert as, say PTFE, and that it leaches chemicals into the sample if exposed to a solvent in the vial. Therefore silicone in the septa is often veneered with a layer of PTFE. The latter provides this inert barrier between the sample and the silicone layer in the septa. The negative property of PTFE is that it is hard to puncture; therefore the PTFE layer is usually thin. PTFE does not reseal at all, but the silicone layer in the sandwich provides the resealing function. Even though most septa are two-layered PTFE/silicone with the inert PTFE layer facing the sample, after a septum is pierced by an autosampler needle, the sample in the vessel is exposed to the silicone layer. As a result, extractables from the silicone may often contaminate the sample, especially with multiple needle punctures.

Materials other than silicone have also been used as septa. They, however, suffer from additional problems. As is well known in the art, septa are normally held in place by compressing the outer periphery thereof between a cap and the sample bottle or other vessel. Sometimes, this forces the flow of septa material away from the compression seal which can be detrimental.

Previous septa have been bonded to caps in order to prevent assembled caps from disassembling during shipment. The prior art bonded septa also prevented thick needles from pushing septa into the vial. There is, therefore, a need for septa that is not required to be bonded to caps.

SUMMARY OF THE INVENTION

The present invention is designed to overcome the deficiencies of the prior art discussed above. It is an object of the present invention to provide a septum that is made from an elastomeric material in a different way than conventional silicone/PTFE septa.

It is another object of the present invention to provide a septum that is made from an elastomeric material but does not require that it be bonded to a cap.

It is a still further object of the present invention to provide such a septum that can be held in place on a bottle without compressing the outer periphery of the elastomeric material between the cap and the bottle or other vessel.

In accordance with the illustrative embodiments, demonstrating features and advantages of the present invention, there is provided a septum that includes a disc made of an elastomeric material other than silicone that is capable of being pierced by a needle and resealing itself when the needle is withdrawn. Embedded in the middle of the disc, from top to bottom, is a ring made of a material that is more rigid than the elastomeric material of the disc. The ring has a center circular opening that is filled by the elastomeric material of the disc. The outer circumference of the ring is greater than the circumference of the disc and extends outwardly beyond the circumference of the disc. The outer part of the ring interacts with the inner screw threads of a cap and supports the septum in the cap. A plurality of additional openings equally spaced about the ring adjacent its outer circumference are also filled with the elastic material of the disc to provide additional support for the septum.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
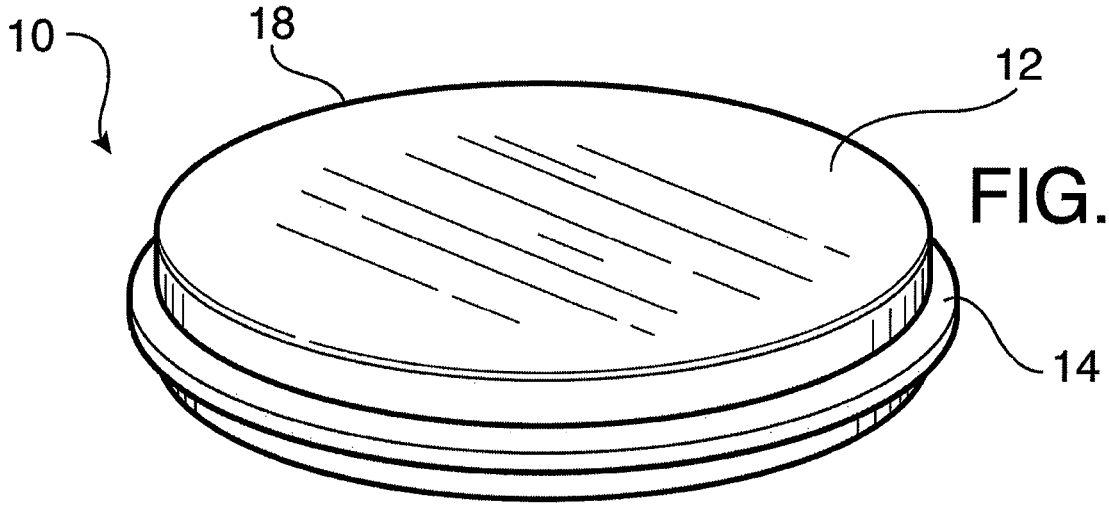
FIG. 1 is a front top perspective view of a septum showing our new invention.
Figure 2:
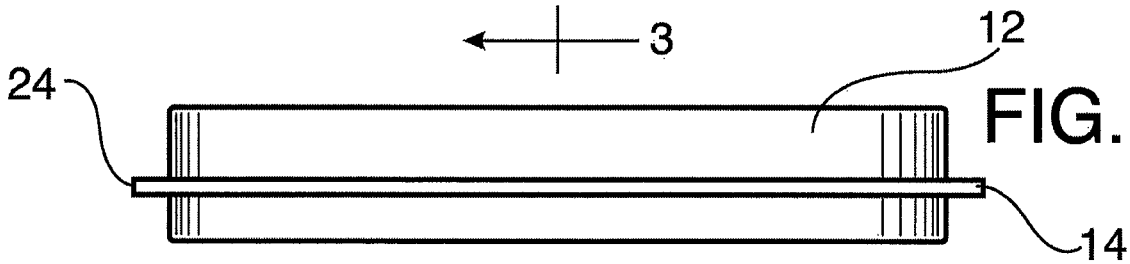
FIG. 2 is a front elevational view thereof.
Figure 3:
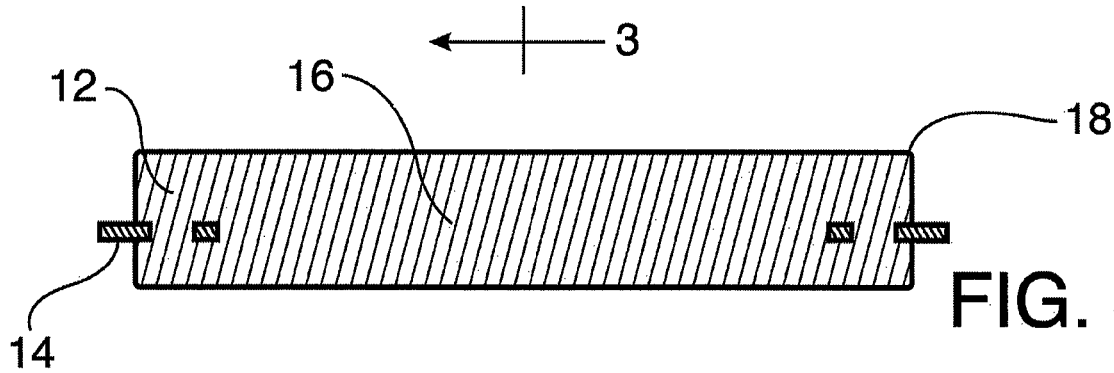
FIG. 3 is a cross-sectional view taken through the line 3-3 of FIG. 2.
Figure 4:
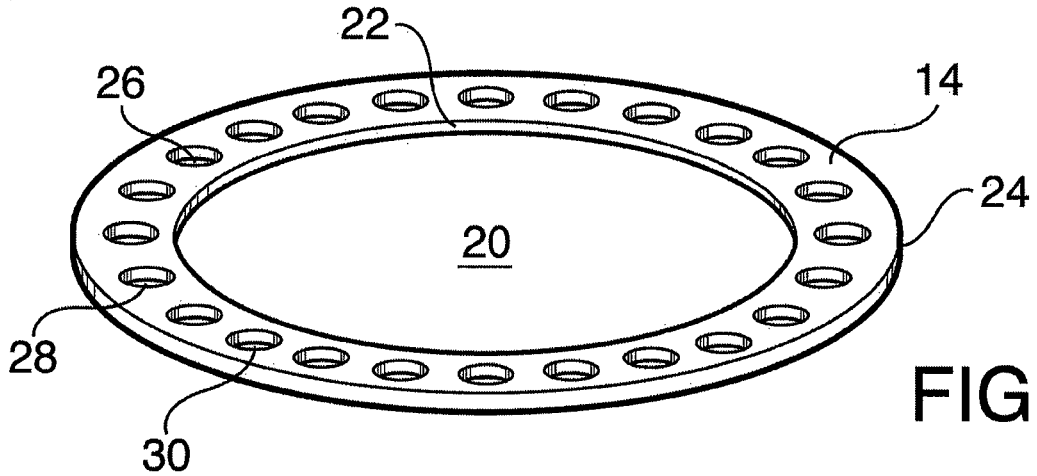
FIG. 4 is a front top perspective view of a ring that forms a part of the septum of our invention.

Referring now to the drawings in detail wherein like reference numerals have been used throughout the various figures to designate like elements, there is shown in FIGS. 1-3 a septum constructed in accordance with the principles of the present invention and designated generally as 10. The septum 10 is comprised essentially of two main parts: a disc shaped member 12 and a ring 14.

The disc 12 is made of an elastomeric material that is capable of being pierced by a needle and resealing itself when the needle is withdrawn. It can be made of an injection molded polymer such as Santoprene, a thermoplastic vulcanizate produced by Exxon Mobil, or a more chemically inert thermoplastic elastomer. In the most preferred embodiment, the elastomeric material is a fluorinated thermoplastic elastomer. As can be seen in the figures, the disc has a thickness which is preferably between about 1 mm and about 3 mm although the thickness may vary depending on the use for which the septum 10 is intended. The disc 12 also has a diameter of between about 8 m and 22 mm, again depending on the intended use of the septum. The disc 12 includes the center or middle portion 16 and a circumference 18 surrounding the same.

The ring 14 is made of a material that is more rigid than the elastomeric material of the disc 12. However, it is still somewhat flexible for the reason that will become apparent below. The ring may be made from various materials but is preferably made from PTFE or polyethylene. The thickness of the ring 14 is less than the thickness of the disc 12 and is preferably between about 0.05 mm to about 0.50 mm.

The ring 14 has a center circular opening 20 having a circumference 22 which is less than the circumference 18 of the disc 12. The outer circumference 24 of the ring 14, however, is greater than the circumference 18 of the disc 12. The ring 14 includes a plurality of additional openings therein such as shown at 26, 28, and 30, etc. which are equally spaced around the ring adjacent the outer circumference 24 thereof.

Figure 6:
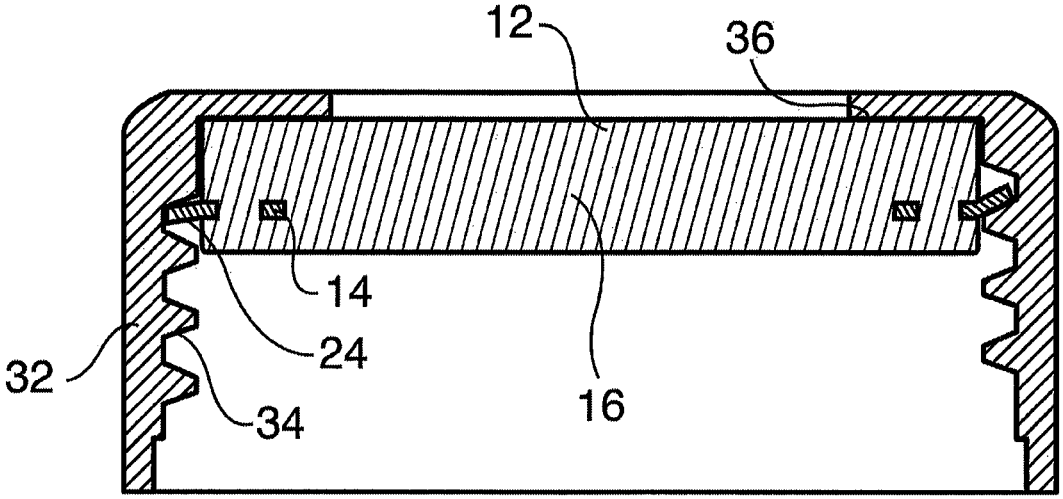
FIG. 6 is a cross-sectional view of the combination of a septum and a cap in accordance with our invention.

As shown most clearly in FIGS. 1, 3 and 6, the ring 14 is located within the disc 14 at substantially the middle of the thickness of the disc with the outer circumference 24 of the ring 14 extending outwardly beyond the circumference 18 of the disc 12. Preferably, the septum 10 is formed by injection molding the disc 12 around the ring 14. This can be done on a large scale by providing the rings (or at least the inner portions of the rings) on a continuous ribbon, injection molding the elastomeric material around selected areas of the ribbon and then cutting by stamping the outer circumference 24 to form the rings 14. During the injection molding process, the elastomeric material flows into and fills the center circular opening 20 of the ring 14 and all of the additional openings 26, 28 and 30 thereof.

Figure 5:
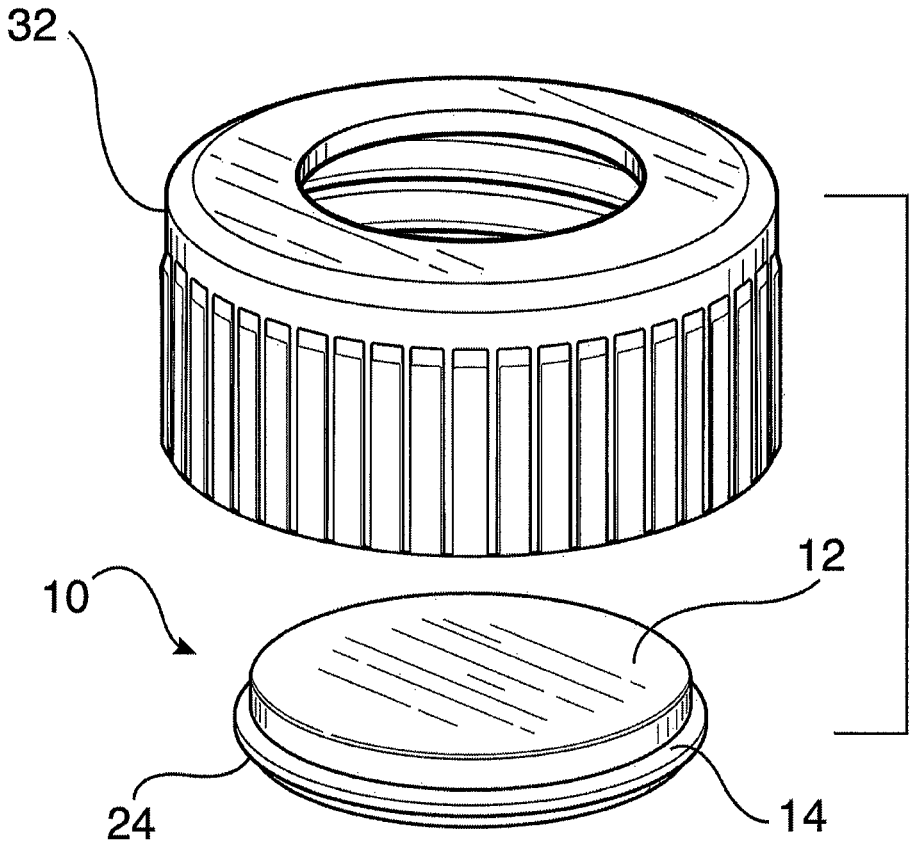
FIG. 5 is a front top perspective view illustrating how the septum of our invention is combined with a cap.

FIGS. 5 and 6 illustrate the manner in which the septum 10 cooperates with a standard cap 32 having internal threads 34. Essentially, the septum 10 is simply pushed upwardly into the open bottom of the cap 32 or the cap is threaded down onto the septum 10. In either case, the exposed portion of the ring 14 that extends beyond the disc 12 engages the threads 34 of the cap 32. As a result, the ring 14 supports the septum 10 in the cap 32 and supports the integrity of the seal between the cap and a bottle or other vessel by preventing the flow of the elastomeric material away from the compression area around the seal.

The present invention may be embodied in other specific forms without departing from the spirit or essential attributes thereof and accordingly, reference should be made to the appended claims rather than to the foregoing specification as indicating the scope of the invention.

We claim:

1. A septum comprising:

a disc comprised of an elastomeric material that is capable of being pierced by a needle and resealing itself when the needle is withdrawn, said disc having a thickness and a circumference and a middle portion;

a ring made of a material that is more rigid than said elastomeric material and having a thickness less than the thickness of said disc, said ring lying within said disc at substantially the middle of the thickness of said disc, said ring having a center circular opening that has a circumference that is less than the circumference of said disc, said ring having an outer circumference that is greater than the circumference of said disc;

said ring including a plurality of additional openings therein adjacent said outer circumference thereof and wherein said elastic material of said disc fills said additional openings, and whereby said ring extends outwardly beyond the circumference of said disc and part of said middle portion of said disc lies within said center opening.

2. The septum as claimed in claim 1 wherein said additional openings are substantially equally spaced around said ring.

3. The septum as claimed in claim 2 wherein said additional openings are round.

4. The septum as claimed in claim 1 wherein said elastomeric material is a chemically inert thermoplastic elastomer.

5. The septum as claimed in claim 4 wherein said ring is made from a material selected from the group consisting of PTFE and polyethylene.

6. The septum as claimed in claim 1 wherein said ring is made from a material selected from the group consisting of PTFE and polyethylene.

7. A septum and bottle cap system comprising:

a cap having a top surface and having an opening in said surface, said cap further including an internal thread;

a septum, said septum including a disc comprised of an elastomeric material that is capable of being pierced by a needle and resealing itself when the needle is withdrawn, said disc having a thickness and a circumference and a middle portion and a ring made of a material that is more rigid than said elastomeric material and having a thickness less than the thickness of said disc, said ring lying within said disc at substantially the middle of the thickness of said disc, said ring having a center circular opening that has a circumference that is less than the circumference of said disc, said ring having an outer circumference that is greater than the circumference of said disc, said ring extending outwardly beyond the circumference of said disc and part of said middle portion of said disc lying within said center opening, and wherein said septum is located within said cap and wherein at least a portion of said outer circumference of said ring is located within said internal thread of said cap.

8. The septum and bottle cap system as claimed in claim 7 wherein said ring includes a plurality of additional openings therein adjacent said outer circumference thereof and wherein said elastic material of said disc fills said additional openings.

9. The septum and bottle cap system as claimed in claim 8 wherein said additional openings are substantially equally spaced around said ring.

10. The septum and bottle cap system as claimed in claim 9 wherein said additional openings are round.

* * * * *